US008992235B2

(12) United States Patent
Kataoka

(10) Patent No.: US 8,992,235 B2
(45) Date of Patent: Mar. 31, 2015

(54) TERMINAL FITTING AND A CONNECTION STRUCTURE FOR A TERMINAL FITTING

(71) Applicant: Sumitomo Wiring Systems, Ltd., Yokkaichi, Mie (JP)

(72) Inventor: Shigeto Kataoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/693,105

(22) Filed: Dec. 4, 2012

(65) Prior Publication Data

US 2013/0165001 A1 Jun. 27, 2013

(30) Foreign Application Priority Data

Dec. 21, 2011 (JP) ..... 2011-279470

(51) Int. Cl.
*H01R 12/00* (2006.01)
*H01R 13/05* (2006.01)
*H01R 12/58* (2011.01)

(52) U.S. Cl.
CPC ..... *H01R 13/05* (2013.01); *H01R 12/585* (2013.01)
USPC ..... 439/82; 439/751

(58) Field of Classification Search
CPC ..... H01R 12/585
USPC ..... 439/82, 751, 567, 873
See application file for complete search history.

(56) References Cited

U.S. PATENT DOCUMENTS 2,006,813 A * 7/1935 Powers ..... 411/352
2,877,441 A * 3/1959 Narozny ..... 439/857
2,950,458 A * 8/1960 Artz ..... 439/872
4,206,964 A * 6/1980 Olsson ..... 439/873
4,435,031 A * 3/1984 Black et al. ..... 439/82
4,606,589 A * 8/1986 Elsbree et al. ..... 439/78
4,655,537 A * 4/1987 Andrews, Jr. ..... 439/751
4,698,026 A * 10/1987 Rolf ..... 439/82
4,769,907 A * 9/1988 Sebastien ..... 29/874
4,878,861 A * 11/1989 Kendall et al. ..... 439/751
5,035,656 A * 7/1991 Patel ..... 439/733.1
5,073,119 A * 12/1991 Soes ..... 439/82
5,147,227 A * 9/1992 Yurko ..... 439/733.1
5,478,257 A * 12/1995 Cachina et al. ..... 439/567
5,564,954 A * 10/1996 Wurster ..... 439/751
5,980,271 A * 11/1999 MacDougall et al. ..... 439/78
6,042,429 A * 3/2000 Bianca et al. ..... 439/733.1
6,077,128 A * 6/2000 Maag et al. ..... 439/751
6,098,281 A * 8/2000 Rudi ..... 29/845
6,149,471 A * 11/2000 Kemp et al. ..... 439/733.1
6,159,043 A * 12/2000 Yao et al. ..... 439/567

(Continued)

FOREIGN PATENT DOCUMENTS

JP 2005-174615 6/2005

*Primary Examiner* — Ross Gushi

(74) *Attorney, Agent, or Firm* — Gerald E. Hespos; Michael J. Porco; Matthew T. Hespos

(57) ABSTRACT

A connection structure for a terminal fitting (20) includes the terminal fitting (20) with a pair of resilient deforming portions (22), a through hole (11) formed in a circuit board (10) as a connection target of the terminal fitting (20) and into which the pair of resilient deforming portions (22) are press-fitted while being resiliently displaced toward each other, and locking portions (28) which are formed by recessing outer edges (24) of the resilient deforming portions (22) and engaged with the inner peripheral surface of the through hole (11) when the resilient deforming portions (22) are press-fit in the through hole (11).

11 Claims, 8 Drawing Sheets

(56) References Cited

U.S. PATENT DOCUMENTS

| | | | | |
|---|---|---|---|---|
| 6,354,849 | B1 * | 3/2002 | Jones | 439/82 |
| 7,044,807 | B2 * | 5/2006 | Furuno et al. | 439/751 |
| 7,074,094 | B2 * | 7/2006 | Kawahara et al. | 439/751 |
| 7,249,981 | B2 * | 7/2007 | Chen | 439/751 |
| 7,377,823 | B2 * | 5/2008 | Chen | 439/751 |
| 7,445,499 | B2 * | 11/2008 | Nunokawa et al. | 439/567 |
| 7,491,897 | B2 * | 2/2009 | Watanabe et al. | 174/266 |
| 7,722,413 | B2 * | 5/2010 | Tonosaki | 439/751 |
| 7,753,742 | B2 * | 7/2010 | Fedder et al. | 439/751 |
| 7,780,483 | B1 * | 8/2010 | Ravlich | 439/751 |
| 7,828,561 | B2 * | 11/2010 | Gueckel | 439/82 |
| 7,891,992 | B2 * | 2/2011 | Veigel | 439/82 |
| 7,946,861 | B2 * | 5/2011 | Sander | 439/82 |
| 8,002,559 | B2 * | 8/2011 | Thiel et al. | 439/82 |
| 8,419,484 | B2 * | 4/2013 | Kawai et al. | 439/733.1 |
| 2003/0236009 | A1 * | 12/2003 | Tsuchiya | 439/82 |
| 2004/0242033 | A1 * | 12/2004 | Hu | 439/82 |
| 2004/0242082 | A1 * | 12/2004 | Tsuchiya | 439/751 |
| 2005/0003704 | A1 * | 1/2005 | Kasahara | 439/567 |
| 2005/0239345 | A1 * | 10/2005 | Furuno et al. | 439/751 |
| 2005/0250356 | A1 * | 11/2005 | Matsumura et al. | 439/82 |
| 2006/0035535 | A1 * | 2/2006 | Kawahara et al. | 439/751 |
| 2006/0264076 | A1 * | 11/2006 | Chen | 439/82 |
| 2007/0010139 | A1 * | 1/2007 | Chen | 439/751 |
| 2007/0212907 | A1 * | 9/2007 | Kramski | 439/82 |
| 2007/0218717 | A1 * | 9/2007 | Veigel | 439/82 |
| 2008/0050946 | A1 * | 2/2008 | Nunokawa et al. | 439/82 |
| 2008/0318453 | A1 * | 12/2008 | Dancison | 439/82 |
| 2010/0093197 | A1 * | 4/2010 | Sander | 439/82 |
| 2013/0165001 | A1 * | 6/2013 | Kataoka | 439/889 |

* cited by examiner

TERMINAL FITTING AND A CONNECTION STRUCTURE FOR A TERMINAL FITTING

BACKGROUND OF THE INVENTION

1. Field of the Invention

The invention relates to a terminal fitting and a connection structure for terminal fitting.

2. Description of the Related Art

Japanese Unexamined Patent Publication No. 2005-174615 discloses a structure for press-fitting a press-fit type terminal fitting into a through hole of a busbar for connection. Two projections are formed on the outer edges of two resilient deforming portions of the terminal fitting that are deformed resiliently when the terminal fitting is press-fit into the through hole. The terminal fitting is press-fit into the through hole so that the projections engage front and rear opening edges in a pressing direction to retain the terminal fitting.

The front projection in the press-fitting direction interferes with the inner peripheral surface of the through hole as the above-described terminal fitting is press-fit into the through hole and the deforming portions displace. The deforming portions restore resiliently when the projections align with the opening edges of the through hole. Thus, the amount of resilient displacements of the deforming portions decreases. Accordingly, resilient restoring forces accumulated in the deforming portions when the terminal fitting is connected to the through hole become smaller than a maximum value in the press-fitting process. The lower resilient restoring forces accumulated in the resilient deforming portions when the terminal fitting is connected to the through hole means a reduced holding force of the terminal fitting in the through hole.

The invention was completed in view of the above situation and an object thereof is to increase a holding force of a terminal fitting in a through hole.

SUMMARY OF THE INVENTION

The invention relates to a terminal fitting with a plurality of resilient deforming portions that are to be press-fit into a hole of a connection target while being resiliently displaced substantially toward each other. At least one lock is formed by recessing an outer edge of the resilient deforming portion and can engage the inner peripheral surface of the hole when the deforming portions are press-fit in the hole.

Resilient restoring forces of the deforming portions cause the lock to engage the inner peripheral surface of the hole when the deforming portions are press-fit in the hole and the resilient restoring forces hold the deforming portions in the hole. The lock is formed by recessing the outer edge of the resilient deforming portion. Thus, the amount of resilient displacement of the deforming portion, i.e. the resilient restoring forces accumulated in the deforming portion, becomes a maximum when the lock is engaged with the hole, and a holding force of the terminal fitting in the hole is large.

A part of an area of the resilient deforming portion facing the inner peripheral surface of the through hole defines a maximum displacement area where the amount of resilient displacement becomes a maximum in a press-fitting process. The lock is arranged only in an area different from the maximum displacement area.

Stresses generated in the resilient deforming portions while press-fitting the deforming portions into the through hole become a maximum in the maximum displacement areas. However, a stress also is generated in the lock when the lock engages the inner peripheral surface of the through hole.

Thus, the lock is arranged only in the area other than the maximum displacement area to avoid a concentration of stress.

At least one opening edge of the lock defines a biting edge for engaging the inner peripheral surface of the hole.

Groups of locks may be formed.

A dimension of each resilient deforming portion in a width direction preferably is substantially constant over the entire length of the resilient deforming portion.

The invention also relates to a connection structure that includes the above-described terminal fitting and at least one hole formed in a connection target of the terminal fitting and into which the resilient deforming portions are to be press-fit while being displaced resiliently toward each other.

The hole preferably is a through hole in a circuit board.

These and other objects, features and advantages of the invention will become more apparent upon reading the following detailed description of preferred embodiments and accompanying drawings. Even though embodiments are described separately, single features may be combined to additional embodiments.

DETAILED DESCRIPTION OF THE PREFERRED EMBODIMENTS

A first embodiment of the invention is described with reference to FIGS. 1 to 5. A connection structure for a terminal fitting 20 according to the first embodiment is for connecting the terminal fitting 20 to a circuit board 10. In the following description, the circuit board 10 is arranged horizontally and the terminal fitting 20 is mounted into the circuit board 10 substantially from above and in an inserting direction ID.

Figure 1:
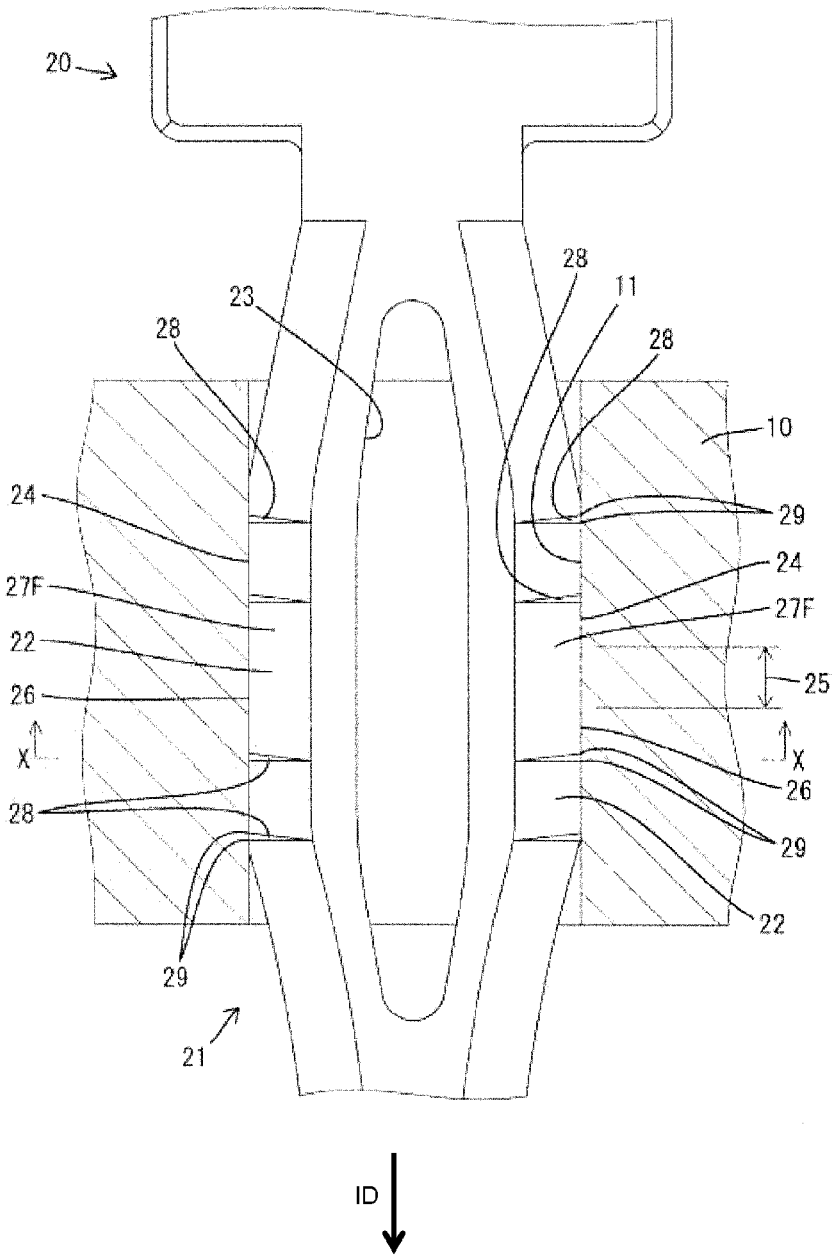
FIG. 1 is a sectional view showing a state where a terminal fitting is press-fitted in a through hole in a first embodiment.
Figure 5:
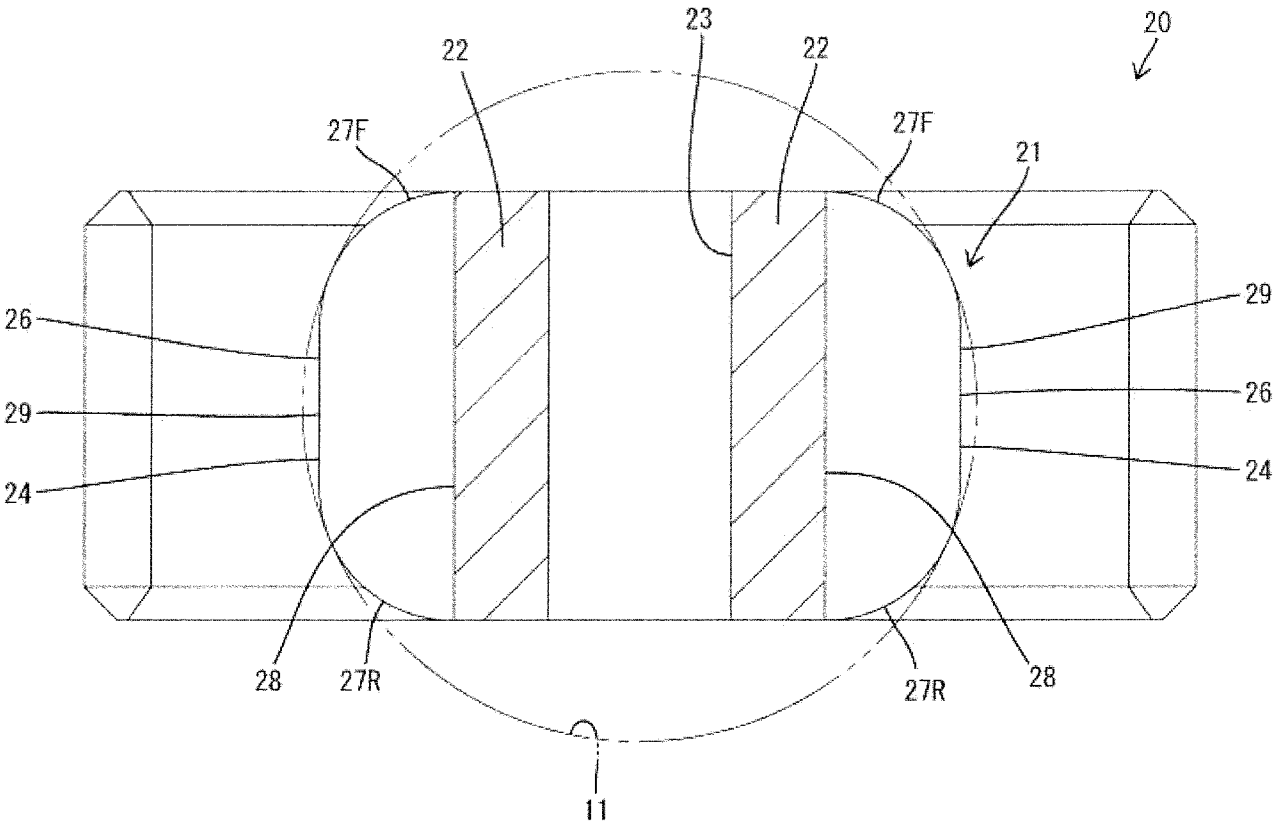
FIG. 5 is a sectional view along X-X of FIG. 1.

A substantially circular through hole 11 penetrates the circuit board 10 in a plate thickness direction, as shown in FIGS. 1 and 5. In the following description, the plate thickness direction of the circuit board 10, a penetrating direction of the through hole 11 and a vertical direction all mean the same. A plating layer (not shown) is formed on the inner peripheral surface of the through hole 11 and is connected to a printed circuit (not shown) of the circuit board 10. An inner diameter of the through hole 11 is substantially constant over the entire length of the through hole 11 from the upper surface to the lower surface of the circuit board 10. A board connecting portion 21 of the terminal fitting 20 is press-fit into the through hole 11 from above and in the inserting direction ID.

The terminal fitting 20 is mounted in a housing (not shown) that is to be mounted on the circuit board 10. A housing-side connecting portion (not shown) is formed at one end of the terminal fitting 20 and is configured for connection to a wiring harness (not shown). The board connecting portion 21 is formed at the other end of the terminal fitting 20 and is configured for connection to the circuit board 10.

Figure 2:
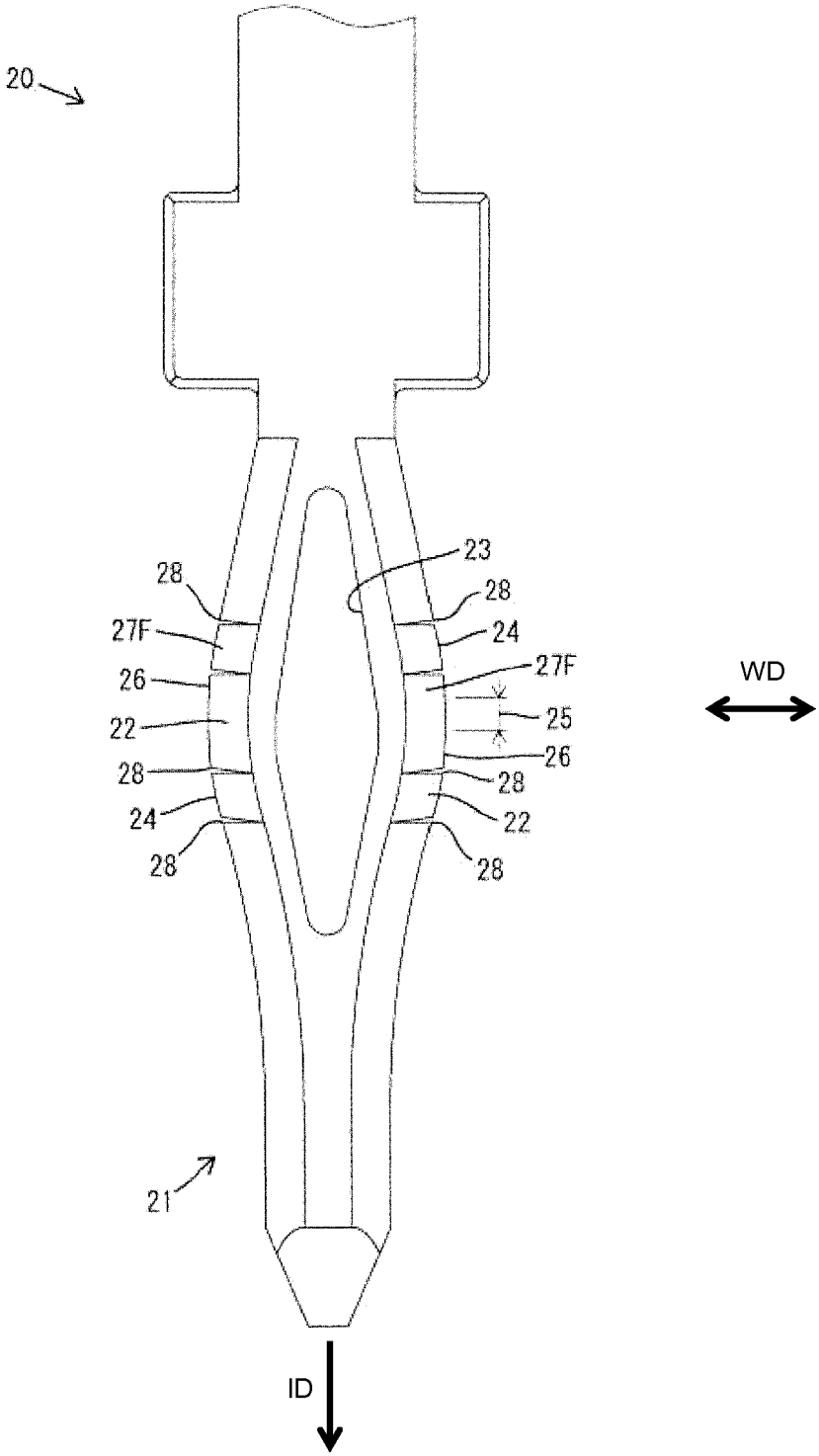
FIG. 2 is a front view of the terminal fitting.
Figure 4:
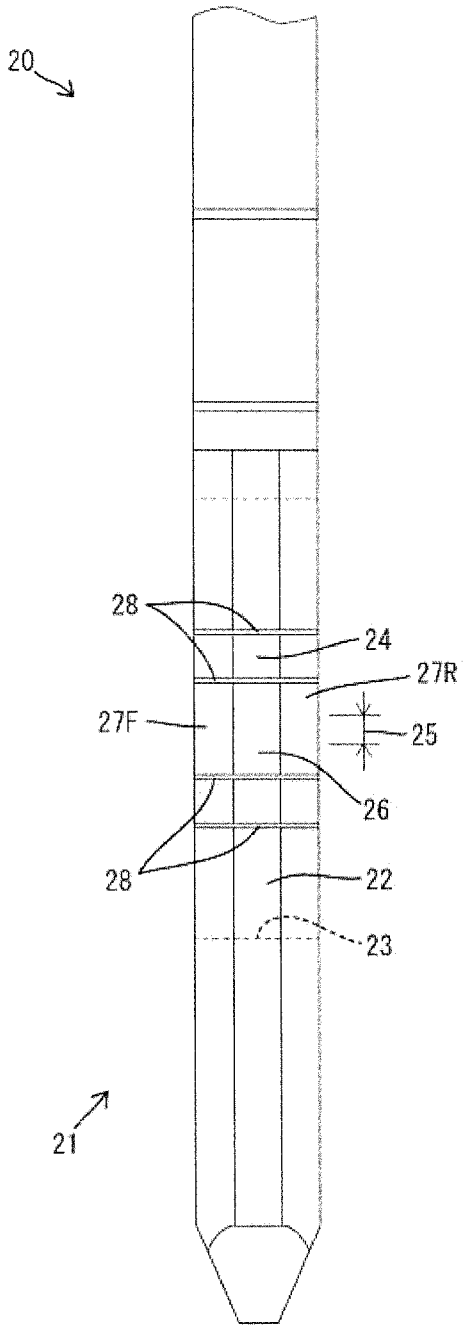
FIG. 4 is a side view of the terminal fitting.

As shown FIGS. 2 and 4, the board connecting portion 21 is long and narrow vertically along the inserting direction ID and the leading end faces down in the inserting direction ID. The board connecting portion 21 has two substantially bilaterally symmetric resilient deforming portions 22 that are long and narrow in a length direction that is substantially parallel to the inserting direction ID into the through hole 11. In the following description, the length direction of the board connecting portion 21, a length direction of the resilient deforming portions 22 and the vertical direction all mean the same direction. A length dimension of the resilient deforming portions 22 in the inserting direction ID is larger than a dimension of the through hole 11 in the thickness direction of the circuit board 10.

Figure 3:
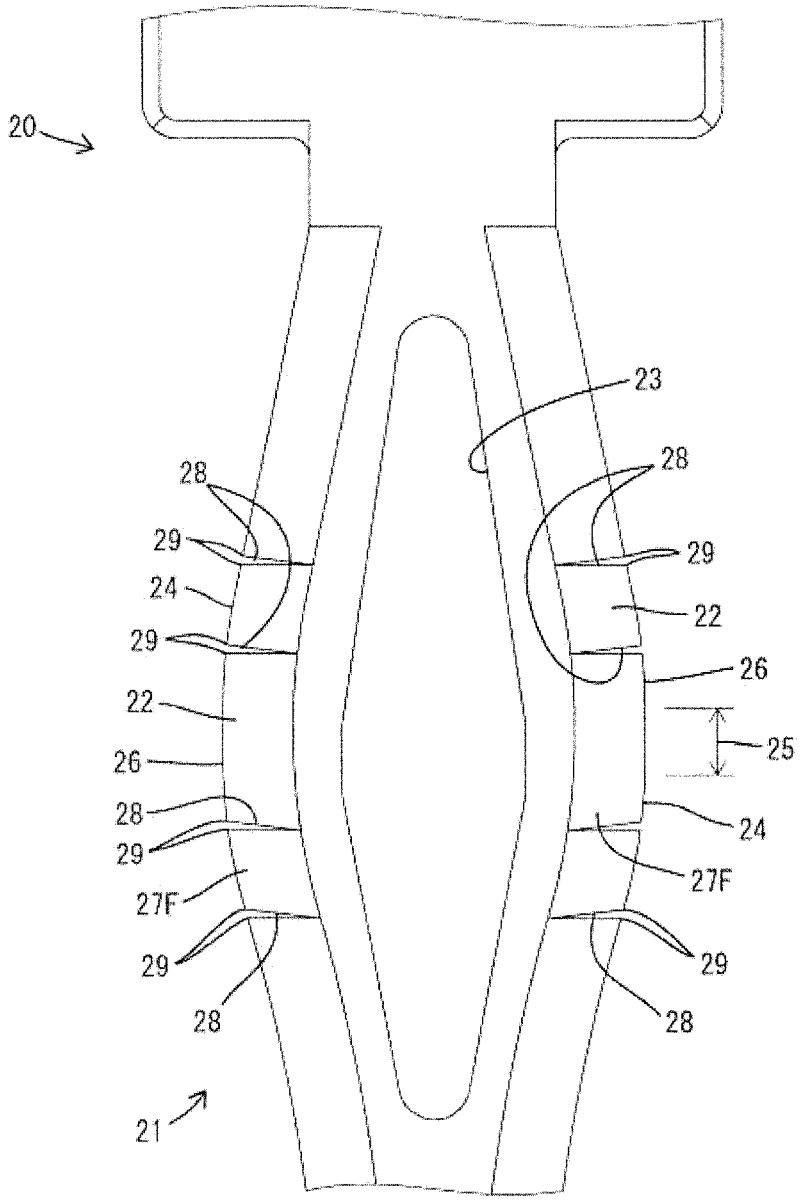
FIG. 3 is a partial enlarged front view of the terminal fitting.

As shown in FIGS. 1 to 3, the resilient deforming portions 22 are spaced apart laterally in a width direction WD of the board connecting portion 21, which is substantially normal to the inserting direction ID. A deformation space 23 is formed between the resilient deforming portions 22 and permits the resilient deforming portions 22 to be deformed resiliently toward each other in the width direction WD. The deformation space 23 penetrates through the board connecting portion 21 in forward and backward directions. In the following direction, the width direction WD of the board connecting portion 21, a width direction of the resilient deforming portions 22 and an arranging direction of the resilient deforming portions 22 all mean the same direction. The width direction WD of the board connecting portion 21 is substantially perpendicular to the vertical press-fitting or inserting direction ID into the through hole 11.

As shown in FIGS. 2 and 3, each resilient deforming portion 22 has a substantially constant dimension in the width direction WD over the entire length of the resilient deforming portion 22. Further, the resilient deforming portions 22 are curved so that a spacing between central parts thereof in the length direction is largest when the board connecting portion 21 is not press-fit in the through hole 11. That is, the pair of resilient deforming portions 22 are curved so that outer edges 24 of the board connecting portions 21 project out in the width direction WD. Accordingly, the width of the board connecting portion 21 is maximum at longitudinal central parts of the resilient deforming portions 22 in the longitudinal direction. As shown in FIGS. 2 and 3, maximum displacement areas 25 of the resilient deforming portions 22 are defined where the board connecting portion 21 is widest and where the resilient displacements of the resilient deforming portions 22 in the width direction WD becomes maximum in the press-fitting process into the through hole 11.

A maximum width of the board connecting portion 21 when board connecting portion 21 is not press-fit in the through hole 11 is larger than the inner diameter of the through hole 11. Thus, the resilient deforming portions 22 are displaced resiliently toward each other in the width direction WD and toward a longitudinal center of the terminal fitting 20 when the board connecting portion 21 is press-fit in the through hole 11, and resilient restoring forces accumulate in the resilient deforming portions 22. The outer edges 24 of the resilient deforming portions 22 contact the inner peripheral surface of the through hole 11 and the resilient restoring forces of the resilient deforming portions 22 ensure a specified contact pressure between the terminal fitting 20 and the through hole 11.

Frictional resistance is generated between the outer edges 24 of the resilient deforming portions 22 and the inner peripheral surface of the through hole 11 as the resilient restoring forces accumulate in the resilient deforming portions 22. This frictional resistance becomes a holding force for holding a press-fit contact state between the outer edges 24 of the terminal fitting 20 and the inner peripheral surface of the through hole 11. In this embodiment, four pairs of locking portions 28 are formed on the outer edges 24 of the left and right resilient deforming portions 22 for further increasing the holding force of the terminal fitting 20 in the through hole 11.

As shown in FIG. 5, the outer edge 24 of the resilient deforming portion 22 has an outer side surface 26 that is substantially perpendicular to the width direction WD and substantially parallel to forward and backward penetrating direction of the deformation space 23, a front arcuate surface 27F that is a substantially quarter-circular connecting the outer side surface 26 and the front surface, and a rear arcuate surface 27F that is a substantially quarter-circular connecting the outer side surface 26 and the rear surface. As shown in FIGS. 1 to 3, the locking portions 28 formed on the left resilient deforming portion 22 and those formed on the right resilient deforming portion 22 are paired. The paired locking portions 28 are arranged substantially at the same heights in the vertical direction and are substantially bilaterally symmetrical.

As shown in FIG. 4, the locking portions 28 are substantially wedge-shaped recesses formed in the outer side surface 26, the front arcuate surface 27F and the rear arcuate surface 27R of the outer edge 24. An opening of each locking portion 28 on the outer edge 24 is a slit substantially perpendicular to the press-fitting inserting direction ID into the through hole 11. That is, the opening of the locking portion 28 is a slit extending in substantially forward and backward directions when viewed in a direction perpendicular to the outer side surface 26. As shown in FIGS. 2 and 3, the opening of the locking portion 28 is a slit extending substantially in the lateral direction when viewed from front and behind. The upper and lower inner surfaces of the locking portion 28 are substantially perpendicular to the outer side surface 26, the front arcuate surface 27F and the rear arcuate surface 27R.

As shown in FIG. 3, opening edges of the locking portion 28 on the outer edge 24 (outer side surface 26, front arcuate surface 27F and rear arcuate surface 27) define upper and lower biting edges 29. As shown in FIGS. 4 and 5, formation areas of the locking portions 28 in forward and backward directions are substantially the entire areas of the resilient deforming portions 22 in the thickness direction (forward and backward directions), i.e. areas from the front surfaces to the rear surfaces of the resilient deforming portions 22. Further, as shown in FIGS. 2, 3 and 5, formation areas of the locking portions 28 in the width direction WD extends over substantially the entire ranges of formation areas of the front arcuate surfaces 27F and the rear arcuate surfaces 27R.

The four pairs of locking portions 28 are arranged one above another in the vertical direction. As shown in FIGS. 2 and 3, the uppermost locking portions 28 and the second locking portions 28 from top are arranged above the maximum displacement areas 25. The bottommost locking portions 28 and the second locking portions 28 from bottom are arranged below the maximum displacement areas 25. Thus, all of the locking portions 28 are arranged in areas other than the maximum displacement areas 25 in the vertical inserting direction ID into the through hole 11. Further, as shown in FIG. 1, all of the locking portions 28 are within the range of an area facing the inner peripheral surface of the through hole 11 (i.e. within the range of the plate thickness of the circuit board 10) when the board connecting portion 21 is press-fit correctly in the through hole 11.

Parts of the resilient deforming portions 22 below the maximum displacement areas 25 interfere with the opening edge on the upper surface of the through hole 11 in the process of press-fitting the board connecting portion 21 in the inserting direction ID into the through hole 11. As a result, the resilient deforming portions 22 are displaced resiliently toward each other. The amount of the resilient displacements gradually increases as the board connecting portion 21 is press-fit into the through hole 11. The board connecting portion 21 reaches a properly press-fit state when the maximum displacement areas 25 reach a substantially central part of the through hole 11, as shown in FIG. 1. At this time, the amount of deformations of the resilient deforming portions 22 is a maximum.

The front and rear arcuate surfaces 27F and 27R of the outer edges 24 face the inner peripheral surface of the through hole 11 when the board connecting portion 21 is inserted in the through hole 11 and are pressed resiliently by the resilient restoring forces of the resilient deforming portions 22, as shown in FIG. 5. Thus, the terminal fitting 20 and the through hole 11 are connected with a specified contact pressure. Further, as shown in FIG. 1, contact areas of the outer edges 24 of the resilient deforming portions 22 with the inner peripheral surface of the through hole 11 in the vertical direction include the entire maximum displacement areas 25, and partial areas above and below the maximum displacement areas 25.

All of the locking portions 28 are arranged within the ranges of the areas of the outer edges 24 of the resilient deforming portions 22 that are held in contact with the inner peripheral surface of the through hole 11. Accordingly, all of the biting edges 29 formed on the locking portions 28 engage with and bite into the inner peripheral surface of the through hole 11 due to the resilient restoring forces of the resilient deforming portions 22. Displacements of the board connecting portion 21 relative to the through hole 11 in the vertical inserting direction ID are prevented or inhibited by the locking action of the biting edges 29. Thus, the terminal fitting 20 is held reliably in the through hole 11.

As described above, the connection structure of this first embodiment includes the terminal fitting 20 with two resilient deforming portions 22 and the through hole 11 in the circuit board 10 is the connection target of the terminal fitting 10 into which the resilient deforming portions 22 are press-fit while being displaced resiliently toward each other. The resilient deforming portions 22 have the locking portions 28 formed by recessing the outer edges 24 and engage the inner peripheral surface of the through hole 11 when the resilient deforming portions 22 are press-fit in the through hole 11.

The locking portions 28 are engaged with the inner peripheral surface of the through hole 11 due to the resilient restoring forces of the resilient deforming portions 22 when the resilient deforming portions 22 are press-fit in the through hole 11, thereby holding the resilient deforming portions 22 in the through hole 11. The locking portions 28 are recessed in the outer edges 24 of the resilient deforming portions 22. Thus, the amount of displacements of the resilient deforming portions 22, i.e. the restoring forces accumulated in the resilient deforming portions 22, becomes a maximum in the press-fitting process when the locking portions 28 engage the through hole 11. Therefore, the holding force of the terminal fitting 20 in the through hole 11 is large.

The locking portions 28 are arranged in the vertical inserting direction ID in areas other than the maximum displacement areas 25 of the resilient deforming portions 22 where the amount of resilient displacement becomes a maximum in the press-fitting process. More particularly, the resilient deforming portions 22 deform resiliently while being press-fit into the through hole 11 to increase a radius of curvature. The amount of resilient displacements of the resilient deforming portions 22 at this time and hence the stress generated in the resilient deforming portions 22 becomes a maximum in the maximum displacement areas 25. On the other hand, when the biting edges 29 bite into the inner peripheral surface of the through hole 11, a deformation occurs to change a distance between the upper and lower biting edges 29 of one locking portion 28 and a stress is generated in the locking portion 28. Accordingly, the locking portions 28 are arranged only in the areas other than the maximum displacement areas 25 to avoid the concentration of stresses in the maximum displacement areas 25.

A second embodiment of the invention is described with reference to FIGS. 6 to 8. The terminal fitting 20 of the first embodiment is formed with the four pairs of locking portions 28, whereas a terminal fitting 30 of this second embodiment is formed with four groups of locking portions 31, with each group being composed of four locking portions 31. Since the other configuration is similar to or the same as in the above first embodiment, the similar elements are denoted by the same reference signs and the structure, functions and effects thereof are not described.

Figure 6:
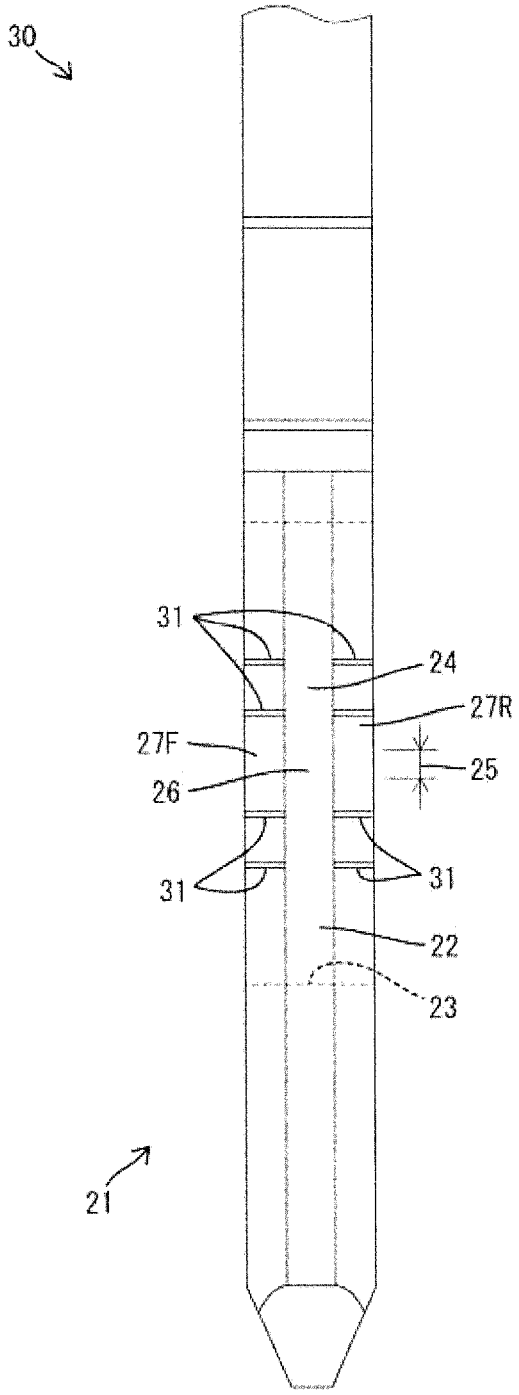
FIG. 6 is a side view of a terminal fitting according to a second embodiment.
Figure 7:
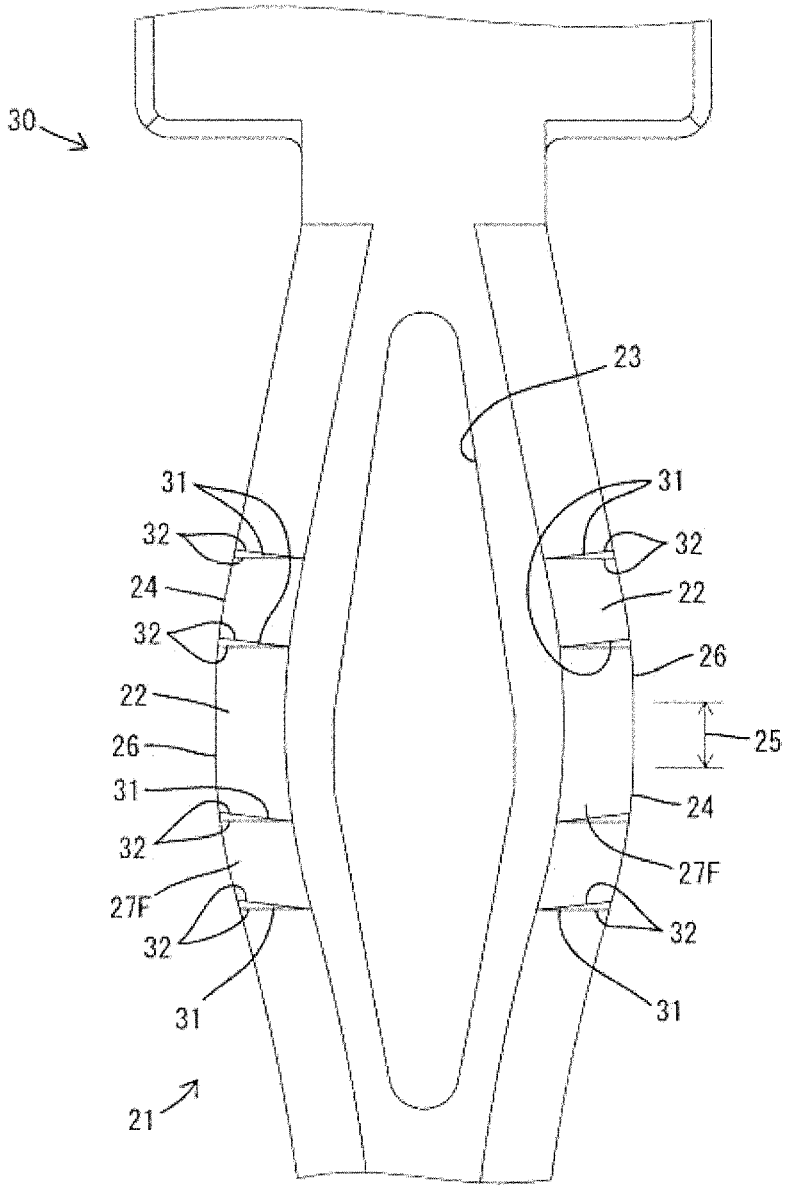
FIG. 7 is a partial enlarged front view of the terminal fitting.
Figure 8:
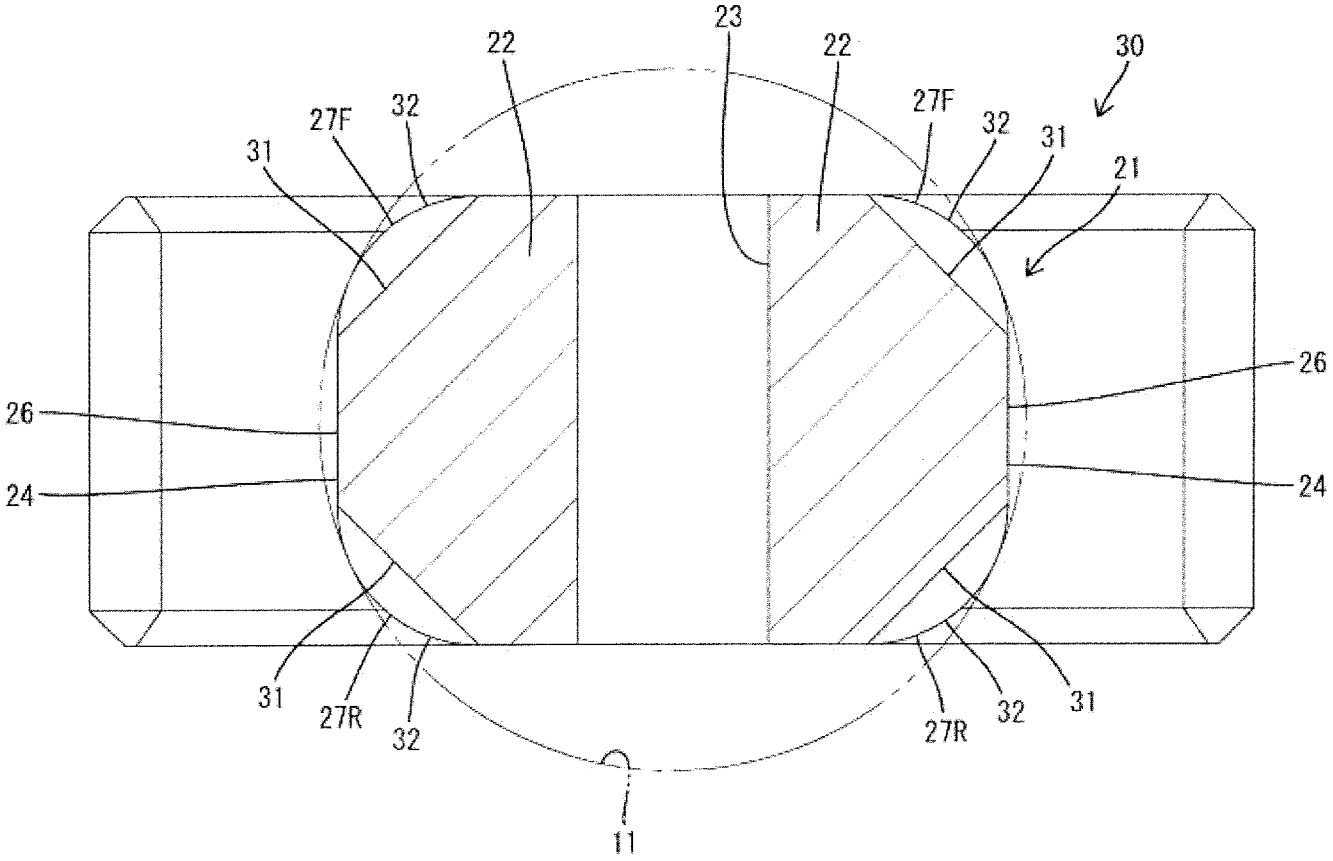
FIG. 8 is a sectional view showing a state where the terminal fitting is press-fitted in a through hole.

As shown in FIG. 8, one group of locking portions 31 is composed of a pair of front and rear locking portions 31 formed on a left resilient deforming portion 22 and a pair of front and rear locking portions formed on a right resilient deforming portion 22. As shown in FIGS. 6 and 7, the locking portions 31 constituting one group are arranged on the same height in the vertical direction and are substantially bilaterally and front-back symmetrical.

The locking portions 31 are substantially are wedge-shaped recesses formed in front arcuate surfaces 27F and rear arcuate surfaces 27R of outer edges 24. As shown in FIGS. 6 and 7, an opening of each locking portion 31 on the outer edge 24 is in the form of a slit substantially perpendicular to the press-fitting inserting direction ID into the through hole 11. Thus, as shown in FIG. 6, the opening of the locking portion 31 is in the form of a slit substantially extending in forward and backward directions when viewed in a direction perpendicular to an outer side surface 26. As shown in FIG. 7, the opening of the locking portion 31 is substantially in the form of a slit extending in the lateral direction when the board connecting portion 21 is viewed from the front and rear. Both upper and lower inner surfaces of the locking portion 31 are substantially perpendicular to the front arcuate surface 27F and the rear arcuate surface 27R.

As shown in FIG. 7, opening edges of the locking portion 31 on the outer edge 24 (front arcuate surface 27F and rear arcuate surface 27R) define upper and lower biting edges 32. As shown in FIGS. 6 and 8, formation areas of the locking portions 31 in forward and backward directions (thickness direction of the resilient deforming portions 22) are the entire ranges of formation areas of the front arcuate surfaces 27F and the entire ranges of formation areas of the rear arcuate surfaces 27R. Further, as shown in FIGS. 7 and 8, formation areas of the locking portions 31 in the width direction WD also are the entire ranges of the formation areas of the front arcuate surfaces 27F and the entire ranges of the formation areas of the rear arcuate surfaces 27R.

As shown in FIGS. 6 and 7, the four groups of locking portions 31 are arranged one above another in the vertical direction. The uppermost locking portions 31 and the second locking portions 31 from top are arranged above maximum displacement areas 25. The bottommost locking portions 31 and the second locking portions 31 from bottom are arranged below the maximum displacement areas 25. Thus, all of the locking portions 31 are arranged in areas other than the maximum displacement areas 25 in the vertical press-fitting direction into the through hole 11. Further, all of the locking portions 31 are arranged within the range of an area substantially facing the inner peripheral surface of the through hole 11 (i.e. within the range of the plate thickness of the circuit board 10) when the board connecting portion 21 is press-fit correctly in the through hole 11.

The invention is not limited to the above described embodiments. For example, the following embodiments also are included in the scope of the invention.

Although the four pairs of locking portions are formed in the first embodiment, the number of the pairs of the locking portions may be fewer or more.

Although four groups each composed of four locking portions are provided in the second embodiment, the number of the groups of the locking portions may be three or less or five or more.

The paired locking portions are substantially bilaterally symmetric in the first and second embodiments. However, the paired locking portions may be bilaterally asymmetric. Moreover, there may be three or more locking portions provided resiliently deformable substantially radially towards and away from a longitudinal center line of the terminal fitting.

The locking portions on the right side and those on the left side are equal in number and paired in the first and second embodiments. However, the number of the locking portions on the right side and on the left side may differ.

Equal numbers of the locking portions are formed in the areas of the resilient deforming portion above and below the maximum displacement area in the first and second embodiments. However, the number of the locking portions above and below the maximum displacement area may differ.

The locking portions are arranged in area of the resilient deforming portion both above and below the maximum displacement area in the first and second embodiments. However, the locking portions may be arranged only in the area above the maximum displacement area or the area below the maximum displacement area.

The locking portions are arranged in areas deviated from the maximum displacement area of the resilient deforming portion in the length direction of the board connecting portion in the first and second embodiments. However, the locking portions may be arranged within the range of the maximum displacement area of the resilient deforming portion in the length direction of the board connecting portion.

Although the terminal fitting is connected to the circuit board in the first and second embodiments, the connection target of the terminal fitting is not limited to the circuit board and may be a busbar or the like according to the invention.

What is claimed is:

1. A terminal fitting, comprising:

first and second resilient deforming portions having inner surfaces facing each other and opposite outer surfaces, front and rear surfaces extending between the inner and outer surfaces, the first and second resilient deforming portions being configured to be press-fit into a hole of a connection target while being resiliently displaced substantially toward each other and having a maximum displacement area where an amount of resilient displacement becomes maximum in a press-fitting process; and at least one locking portion formed by recessing the outer surface of the first and second resilient deforming portions, the at least one locking portion extending between the front and rear surfaces and configured to be engaged with an inner peripheral surface of the hole when the resilient deforming portions are press-fit in the hole and the locking portion being in an area other than the maximum displacement area.

2. The terminal fitting of claim 1, wherein the locking portion has at least one biting edge to be engaged with the inner peripheral surface of the hole.

3. The terminal fitting of claim 1, wherein at least one of the resilient deforming portions has at least one group of locking portions.

4. The terminal fitting of claim 1, wherein a dimension of each resilient deforming portion in a width direction is substantially constant over an entire length of the resilient deforming portion.

5. The terminal fitting of claim 1, wherein the at least one locking portion has a slit-shaped opening on the outer surface of the first and second resilient deforming portions extending between the front and rear surfaces and arranged perpendicular to a press-fitting insertion direction of the first and second resilient deforming portions.

6. The terminal fitting of claim 5, wherein the at least one locking portion has upper and lower inner surfaces extending from opposite edges of the slit-shaped opening toward the inner surfaces of the first and second resilient deforming portions and the upper and lower surfaces are arranged perpendicular to the slit-shaped opening.

7. A terminal fitting, comprising:

a plurality of resilient deforming portions and a deformation space formed between the resilient deforming portions, the resilient deforming portions being resiliently displaceable toward each other and into the deformation space, each of the resilient deforming portions having an inner surface facing the deformation space, an outer surface extending along a side of the resilient deforming portion opposite the deformation space and opposite front and rear surfaces extending between the inner and outer surfaces, and at least one locking recess formed in the outer surface of each of the resilient deforming portions and extending between the front and rear surfaces, each of the resilient deforming portions having as a maximum displacement area where the resilient deforming portions are farthest from one another, the locking recess being arranged in an area other than the maximum displacement area.

8. The terminal fitting of claim 7, wherein each of the locking recesses has at least one biting edge.

9. The terminal fitting of claim 8, wherein at least one of the resilient deforming portions has at least one group of locking recesses.

10. The terminal fitting of claim 7, wherein the at least one locking portion has a slit-shaped opening on the outer surface of the resilient deforming portions extending between the front and rear surfaces and arranged perpendicular to a press-fitting insertion direction of the first and second resilient deforming portions.

11. The terminal fitting of claim 10, wherein the at least one locking portion has upper and lower inner surfaces extending from opposite edges of the slit-shaped opening toward the inner surfaces of the resilient deforming portions and the upper and lower surfaces are arranged perpendicular to the slit-shaped opening.

* * * * *